United States Patent [19]

Van Fulpen

[11] Patent Number: 5,072,877

[45] Date of Patent: Dec. 17, 1991

[54] CARTON INCLUDING DETACHABLE COUPON

[75] Inventor: Lisa Van Fulpen, Galesburg, Mich.

[73] Assignee: Kellogg Company, Battle Creek, Mich.

[21] Appl. No.: 604,157

[22] Filed: Oct. 29, 1990

[51] Int. Cl.[5] ..... B65D 5/10

[52] U.S. Cl. ..... 229/155; 206/459; 206/831

[58] Field of Search ..... 229/155; 206/831, 459; 40/312

[56] References Cited

U.S. PATENT DOCUMENTS

| | | | |
|---|---|---|---|
| 3,062,430 | 11/1962 | Rutledge | 206/831 |
| 3,625,412 | 12/1971 | Rosenburg, Jr. | 206/831 |
| 3,792,810 | 2/1974 | Tingley et al. | 229/155 |
| 4,108,350 | 8/1978 | Forbes, Jr. | 206/459 |
| 4,398,661 | 8/1983 | Schillinger | 229/155 |
| 4,834,240 | 5/1989 | Dagostine | 206/459 |

*Primary Examiner*—Stephen Marcus
*Assistant Examiner*—Christopher McDonald
*Attorney, Agent, or Firm*—Oblon, Spivak, McClelland, Maier & Neustadt

[57] ABSTRACT

A carton made from a planar blank by gluing a glue tab hingedly connected to one panel to the inner surface of the adjacent panel. A coupon is hingedly connected to the glue tab by a tear line. Thus, at least a portion of the coupon makes planar abutting contact with the inner surface of the panel to which the glue tab is glued.

10 Claims, 3 Drawing Sheets

CARTON INCLUDING DETACHABLE COUPON

FIELD OF THE INVENTION

This invention relates to cartons such as dry foods are conventionally sold in. In particular, it relates to such cartons that include a detachable and redeemable coupon as a part of the carton.

BACKGROUND OF THE INVENTION

This invention is an improvement on the carton shown in U.S. Pat. No. 4,872,555, issued on Oct. 10, 1989, to Shadrach et al.

SUMMARY OF THE INVENTION

This invention relates to a conventional carton made from a planar blank by gluing a glue tab hingedly connected to one panel to the inner surface of the adjacent panel. In the carton according to the invention, a coupon (also referred to herein as "a redeemable commercial information panel") is hingedly connected to the glue tab by a tear line. Thus, at least a portion of the coupon makes planar abutting contact with the inner surface of the panel to which the glue tab is glued.

DETAILED DESCRIPTION OF THE PRESENTLY PREFERRED EMBODIMENT OF THE INVENTION

Figure 1:
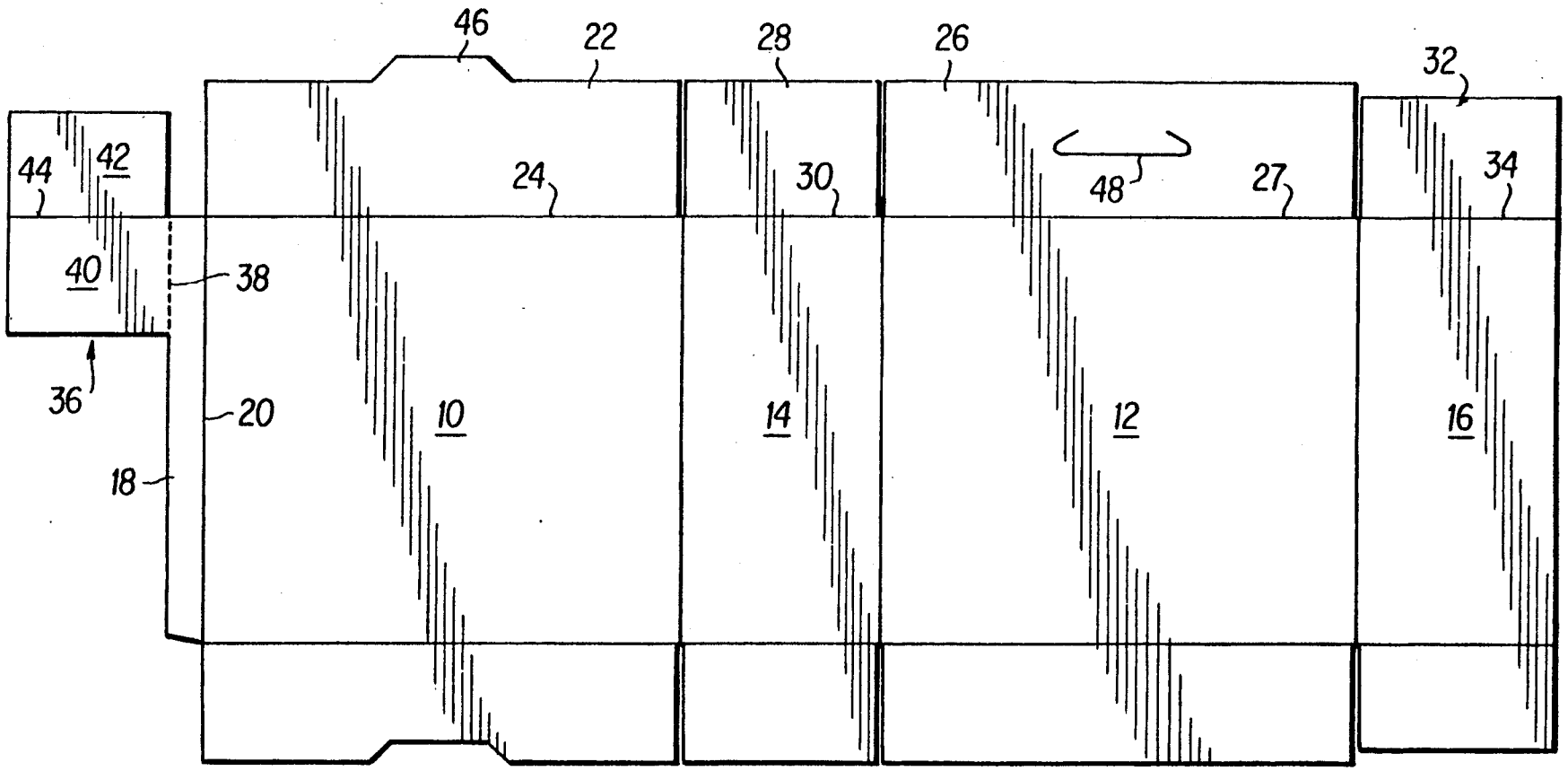
FIG. 1 is a planar view of a blank from which a carton according to this invention can be assembled.

A blank from which a carton according to this invention can be assembled in shown in FIG. 1. It comprises a front panel 10, a back panel 12, a first side panel 14, a second side panel 16, a glue tab 18 hingedly connected to the front panel 10 along a first hinge line 20, a first major flap 22 hingedly connected to the front panel 10 along a second hinge line 24, a second major flap 26 hingedly connected to the back panel 12 along a third hinge line 27, a first minor flap 28 hingedly connected to the first side panel 14 along a fourth hinge line 30, and a second minor flap 32 hingedly connected to the second side panel 16 along a fifth hinge line 34. A redeemable commercial information panel 36 is hingedly connected to the glue tab 18 by a tear line 38.

Preferably the redeemable commercial information panel 36 comprises a first segment 40 that is hingedly connected to the glue tab 18 by the tear line 38 and a second segment 42 that is hingedly connected to the first segment 40 along a sixth hinge line 44.

In the disclosed embodiment, a male tab 46 on the first major flap 22 and a female slot 48 in the second major flap 26 together comprise means for reclosing the major flaps after they have been opened by the consumer. However, as will be apparent, the positions of the male tab 46 and the female slot 48 could be reversed, and other equivalent means for reclosing the major flaps after they have been opened by the consumer could be sustituted for those illustrated.

Figure 2:
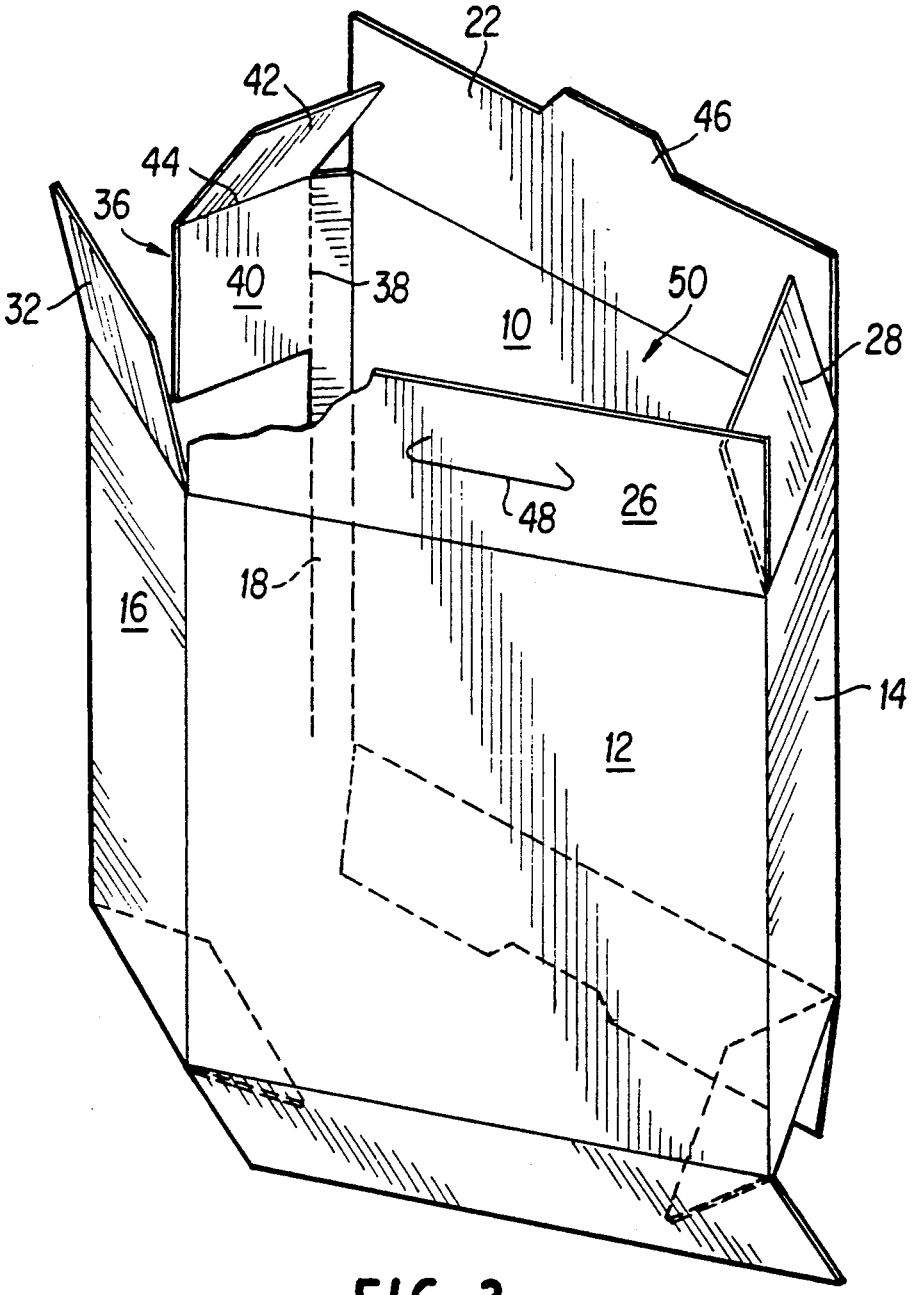
FIG. 2 is an isometric view showing a carton according to this invention being folded into assembled condition.
Figure 3:
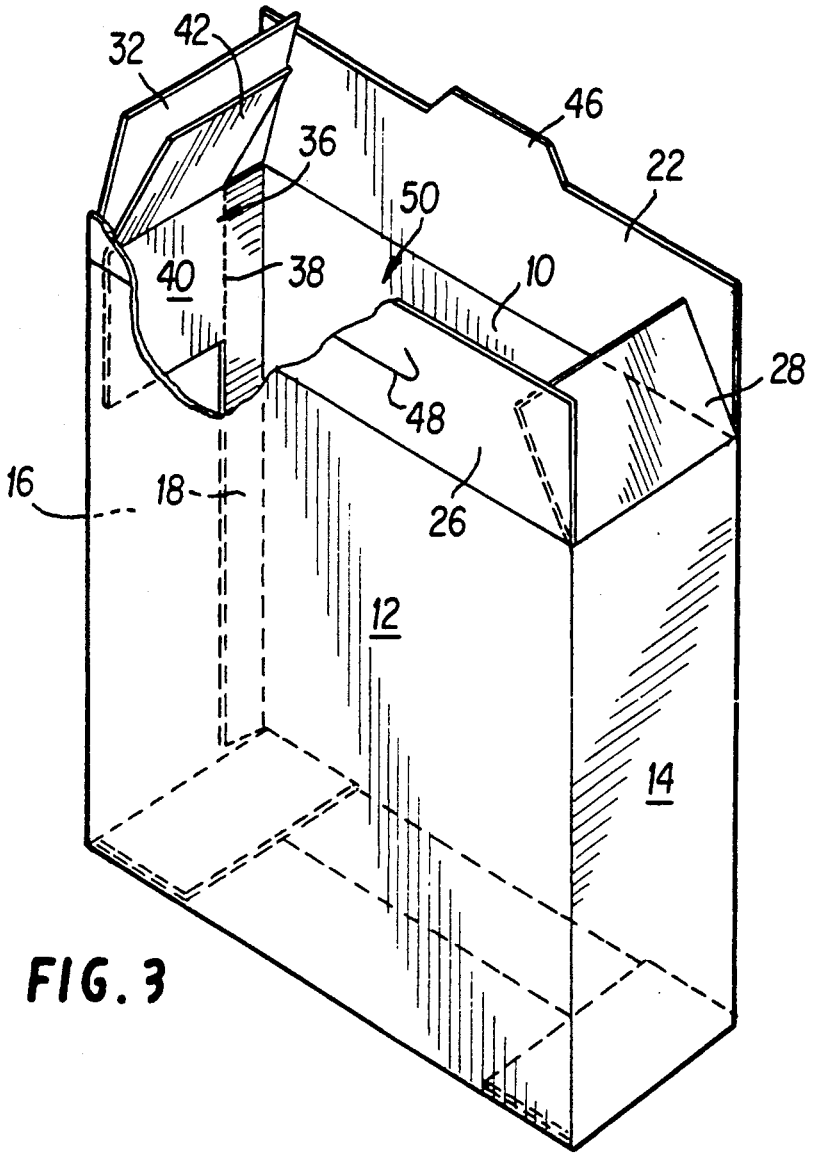
FIG. 3 is an isometric view showing a carton according to this invention folded and glued, but with the top open.
Figure 4:
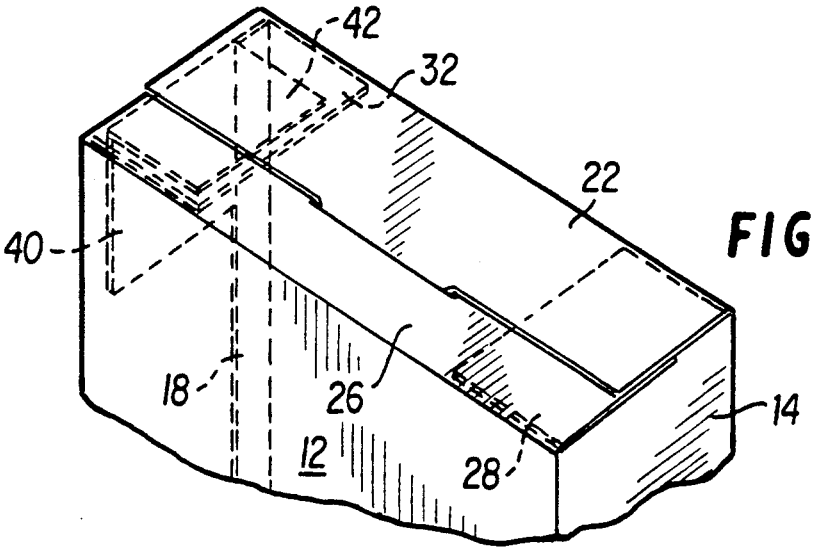
FIG. 4 is an isometric view showing the top of the carton with the top closed.

FIG. 2 shows the blank of FIG. 1 being folded into assembled condition, and FIGS. 3 and 4 show the blank of FIGS. 1 and 2 in assembled condition——that is, as a carton. As will be apparent particularly from FIGS. 3 and 4, when the carton is assembled the front panel 10, the back panel 12, and the first and second side panels 14 and 16 together form an at least generally rectangular parallele-pipedal box with a top opening 50. The first major flap 22, the second major flap 26, the first minor flap 28, and the second minor flap 32 all extend into the top opening 50——and, in fact, close the top opening 50 in a recloseable manner. The redeemable commercial information panel 36 is folded under the first major flap 22, the second major flap 26, and the second minor flap 32. Specifically, in the illustrated embodiment the first segment 40 of the redeemable commercial information panel 36 makes planar abutting contact with the second side panel 16, and the second segment 42 of the redeemable commercial information panel 36 makes planar abutting contact with the inner surface of the second minor flap 32. However, the redeemable commercial information panel 36 could obviously be positioned differently relative to the various flaps and panels depending on the positioning of the glue tab 18.

In use, an inner container (not illustrated) made of cellophane or the like would normally be contained within the carton and would normally contain the actual food. However, that is conventional, not a feature of this invention, and may in fact be omitted.

CAVEAT

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the United States is:

1. A carton comprising:

(a) a front panel;

(b) a back panel;

(c) a first side panel;

(d) a second side panel;

(e) a glue tab hingedly connected to one of said panels along a first hinge line and glued to the inner surface of the adjacent one of said panels;

(f) said front panel, said back panel, and said first and second side panels together forming an at least generally rectangular parallelpipepedal box with a top opening;

(g) a first major flap hingedly connected to said front panel along a second hinge line and extending into said top opening;

(h) a second major flap hingedly connected to said back panel along a third hinge line and extending into said top opening;

(i) at least one minor flap hingedly connected to said first side panel along a fourth hinge line and extending into said top opening; and (j) a redeemable commercial information panel hingedly connected to said glue tab by a tear line, said redeemable commercial information panel comprising:

(i) a first segment that is hingedly connected to said glue tab by said tear line and that makes planar abutting contact with said adjacent one of said panels and (ii) a second segment that is hingedly connected to said first segment along a sixth hinge line and that makes planar abutting contact with the inner surface of one of said flaps.

2. A carton as recited in claim 1 wherein said redeemable commercial information panel is connected to said glue tab adjacent said top opening.

3. A carton as recited in claim 1:

(a) wherein said at least one minor flap is a first minor flap and (b) further comprising a second minor flap hingedly connected to said second side panel along a fifth hinge line and extending into said top opening.

4. A carton as recited in claim 3 wherein:

(a) said adjacent one of said panels is one of said side panels and (b) said one of said flaps is one of said minor flaps.

5. A carton as recited in claim 1 wherein:

(a) said adjacent one of said panels is one of said side panels and (b) said one of said flaps is said at least one minor flap.

6. A carton comprising:

(a) a front panel;

(b) a back panel;

(c) a first side panel;

(d) a second side panel;

(e) a glue tab hingedly connected to one of said panels along a first hinge line and glued to the inner surface of the adjacent one of said panels;

(f) said front panel, said back panel, and said first and second side panels together forming an at least generally rectangular parallelepipedal box with a top opening;

(g) a first major flap hingedly connected to said front panel along a second hinge line and extending into said top opening;

(h) a second major flap hingedly connected to said back panel along a third hinge line and extending into said top opening;

(i) at least one minor flap hingedly connected to said first side panel along a fourth hinge line and extending into said top opening;

(j) a redeemable commercial information panel hingedly connected to said glue tab by a tear line, said redeemable commercial information panel comprising:

(i) a first segment that is hingedly connected to said glue tab by said tear line and that makes planar abutting contact with said adjacent one of said panels and (ii) a second segment that is hingedly connected to said first segment along a sixth hinge line and that makes planar abutting contact with the inner surface of one of said flaps; and (k) means for reclosing said major flaps.

7. A carton as recited in claim 6 wherein said redeemable commercial information panel is connected to said glue tab adjacent said opening.

8. A carton as recited in claim 6:

(a) wherein said at least one minor flap is a first minor flap and (b) further comprising a second minor flap hingedly connected to said second side panel along a fifth hinge line and extending into said top opening.

9. A carton as recited in claim 8 wherein:

(a) said adjacent one of said panels is one of said side panels and (b) said one of said flaps is one of said minor flaps.

10. A carton as recited in claim 6 wherein:

(a) said adjacent one of said panels is one of said side panels and (b) said one of said flaps is said at least one minor flap.

* * * * *